US005287808A

United States Patent [19]

Lippold

[11] Patent Number: 5,287,808

[45] Date of Patent: Feb. 22, 1994

[54] METHOD AND SYSTEM FOR POSITIONING INK-METERING COMPONENTS RELATIVE TO A DUCT ROLLER OF A PRINTING MACHINE

[75] Inventor: Andreas Lippold, Nidderau, Fed. Rep. of Germany

[73] Assignee: MAN Roland Druckmaschinen AG, Fed. Rep. of Germany

[21] Appl. No.: 950,783

[22] Filed: Sep. 24, 1992

[30] Foreign Application Priority Data

Sep. 24, 1991 [DE] Fed. Rep. of Germany ..... 4131679

[51] Int. Cl.[5] ..... B41F 31/04; B41F 33/00

[52] U.S. Cl. ..... 101/365; 101/DIG. 47

[58] Field of Search ..... 101/365, DIG. 47, DIG. 45, 101/484, 485, 350, 363, 207, 208-210, 148, 366; 340/680, 691, 692

[56] References Cited

U.S. PATENT DOCUMENTS 4,392,431 7/1983 Wieland ..... 101/483
4,711,175 12/1987 Hummel ..... 101/365
4,799,625 1/1989 Weaver, Jr. ..... 241/30

FOREIGN PATENT DOCUMENTS

3033995C2 11/1984 Fed. Rep. of Germany .
3503736C1 12/1985 Fed. Rep. of Germany .
3630288A1 3/1988 Fed. Rep. of Germany .
3727656A1 3/1989 Fed. Rep. of Germany .
3914831A1 11/1990 Fed. Rep. of Germany .

*Primary Examiner*—J. Reed Fisher
*Attorney, Agent, or Firm*—Leydig, Voit & Mayer, Ltd.

[57] ABSTRACT

A method and system are provided for establishing a reference position of ink-metering elements relative to a duct roller of a printing machine. The reference position is established by moving the ink-metering element toward the duct roller while acoustically sensing for contact. When a noise level indicative of the ink-metering element being in contact with the roller is detected, the reference, or zero position is established. At that precise moment, a representative value which varies with the distance between the element and the roller is stored as the zero position.

15 Claims, 2 Drawing Sheets

METHOD AND SYSTEM FOR POSITIONING INK-METERING COMPONENTS RELATIVE TO A DUCT ROLLER OF A PRINTING MACHINE

FIELD OF THE INVENTION

The invention relates generally to printing machines, and more particularly to a method and system for positioning ink-metering components relative to a duct roller of a printing machine.

BACKGROUND OF THE INVENTION

In typical sheet-fed offset printing machines, the printing ink is conveyed from a duct cooperating with a duct roller to a printing plate. More specifically, the ink ultimately is conveyed to the printing plate via a lifting roller and a number of additional inking rollers. Ordinarily, a number of ink-metering components, or elements, are disposed in the lower part of the duct in order to control the amount of ink delivered to the inking roller. These elements allow zonal ink-metering transverse to the direction of printing, i.e., across the duct roller, and as required by the printing plate. Typically, these elements are positioned in close proximity to the duct roller so as to produce an ink layer of defined thickness on the roller when it rotates. The thickness of the ink layer depends on the distance, or gap, between the ink-metering elements and the duct roller.

The ink-metering elements can be in the form of a slide with a movable tip (U.S. Pat. No. 4,711,175 corresponding to German Patent No. DE 3 503 736 C1), a blade-like ink-metering attachment integrally formed on a pivoting arm (U.S. Pat. No. 4,392,431, corresponding to German Patent No. DE 3 033 995 C2) or a duct blade divided into tongues the width of an inking zone. Preferably, each ink-metering element is associated with a remote-control adjusting drive, so that the positions of the ink-metering elements relative to the roller in all of the inking devices can be remotely adjusted from a central location.

The structure and operation of one such remotely controllable ink-metering system is shown in German patent No. DE 3 914 831 A1. In this type of system, it is necessary to periodically position the ink-metering elements so that they touch the duct roller (a position known as zero inking). This is done so that a reference position can be established by detecting the position while an element is in contact with the roller (i.e., at zero position). The reference position (in actuality a value such as an analog signal representative thereof) is then utilized for subsequent remote-controlled positioning operations.

These zeroing operations can be performed manually by a printer, who adjusts each individual ink-metering element of an ink-metering system to the zero inking (contact) position. When the desired position is achieved, the printer actuates a switch or other actuating device, whereupon a value representative of the position is stored in the remote-control system for use as the zero reference position.

As can be readily appreciated, such a manual procedure is time-consuming if there are a number of ink-metering elements (for example fifty or so) on a duct roller and a number of printing units in a printing machine. One attempt to simplify the zero positioning of the elements has been proposed in German Patent No. DE 3 914 831 A1, which provides sensors on the individual ink-metering elements. These sensors provide a distance signal corresponding to the position of the ink-metering element relative to the duct roller. At the moment that one of the aforementioned sensors, which operate without contact, ceases to deliver a signal varying in time as the ink-metering element approaches the roller, the ink-metering element is determined to be touching the duct roller (zero inking) and this precise sensor position is stored and used as the zero position. Alternatively, a separate signal, such as a voltage which varies as a function of the distance between the element and the roller, can be stored at the moment of contact as a characteristic voltage associated with the zero position. Thus, this method and system is able to automatically store the values representative of the zero positions. Although this method works efficiently, one of the major drawbacks to this system is that the sensors required for working the method greatly increase the cost of the ink-metering system.

German Patent No. DE 3 727 656 A1 discloses an ink-metering device comprising a duct with a duct blade divided into tongues the width of a zone and a duct roller electrically insulated from the duct and duct blade. Each individual tongue of the duct blade (the ink-metering element) essentially constitutes a switch which can be electrically interrogated; it becomes closed at the exact time that the ink-metering element is adjacent the duct roller. While this system also allows automated zero positioning, a disadvantage of this device is that the aforementioned principle is impracticable in situations where ink having high electric conductivity (for example, an ink containing metal) is used. A duct containing ink of this kind has to be emptied and cleaned before this type of zeroing can be performed.

OBJECTS AND SUMMARY OF THE INVENTION

Accordingly, it is an object of the present invention to provide a simple, inexpensive and reliable method and system for facilitating the establishment of a reference position for ink-metering elements relative to a duct roller.

It is another object of the invention to provide such a method and system that requires only a slight and inexpensive modification of existing ink-metering elements.

It is yet another object of the invention to provide a method and system for obtaining the zero positions of metering elements that will function regardless of the conductive characteristics of the ink.

This problem is solved by a system and method for establishing a reference position for ink-metering elements relative to a duct roller of printing machines. The method generally comprises the steps of rotating the duct roller, and moving the ink-metering element toward the rotating duct roller while monitoring the physical position of the ink-metering element. While the movement of the ink-metering element is occurring, the sound level is acoustically sensed in the environment surrounding the ink-metering element. When a predetermined change in the sound level is sensed, (the change being indicative of the ink-metering element contacting the rotating duct roller), the physical position of the ink-metering element is recorded as the reference position.

The system comprises means for providing a signal corresponding to the distance between the ink-metering elements and the duct roller, along with an acoustic sensor associated with the ink-metering element which senses a sound level in the environment surrounding the ink-metering element and provides an electrical output signal corresponding thereto. Evaluating means responsive to the electrical signal output by the acoustic sensor provide a first signal indicative of a sensed sound level below a threshold level and a second signal indicative of a sensed sound level above the threshold level. A motor moves the ink-metering element relative to the duct roller as operated by a control means. The control means also receives and controls the storage of the distance between the ink-metering element and the duct roller when the evaluating means changes from outputting the first signal to outputting the second signal, which occurs as the acoustic level changes when the ink-metering element contacts the duct roller.

According to the invention, a sound transducer for detecting noise levels is disposed in the tip of an ink-metering element, the element being constructed more particularly as described in U.S. Pat. No. 4,711,175 (corresponding to German Patent No. DE 3 503 736 C1). When the ink-metering element or its tip is disposed in contact with a rotating duct roller, a certain noise level is produced at the tip of the ink-metering element and is thereby detectable. This detected noise is used to indicate a zero position of the ink-metering element.

The noise resulting from the contact between the ink-metering element and the roller is at a level adequate for accurate determination and can be measured precisely in a movable tip of an ink-metering element. The level of noise produced and measured at the tip of the ink-metering element is influenced only very slightly by any printing ink in the duct. The nature of the ink is also immaterial.

In principle, the airborne noise caused by the rotation of the roller may be detected instead of the noise that results form actual contact. Although this allows a reference position to be detected without contact, the measureable sound level of the airborne noise is generally too low to be useful owing to the very smooth surface of the duct roller. Instead, therefore, the noise that results in the structure of the moveable tip as a result of contact with the roller generally provides a more useful sound level for detection. This level is only reduced by the amount of interfering noise in the air and by the ink in the duct, both of which are relatively insubstantial.

The invention is not limited in application to ink-metering elements having a movable tip, but can also be applied to duct blades divided into zones or to blade-like ink-metering attachments integrally formed on a pivoting arm.

The transducer for detecting the noise levels according to the invention is preferably in the form of a miniature piezo-ceramic noise transducer. Such transducers are very compact and are also relatively inexpensive. They can easily be disposed in a bore in an ink-metering element and acoustically coupled to the mass thereof, such as by means of an adhesive.

In accordance with the present invention, ink-metering elements in printing machines can be automatically moved to a zero reference position in a simple manner. Each individual ink-metering element is moved under the control of a program from an "opened" position towards the duct roller until a noise sensor in the ink-metering element (or the tip thereof) detects noise at a predetermined level as a result of physical contact being made with the roller. As soon as the noise level increases abruptly, the position—a representative value of which may be concurrently read from a separate position detecting means—is stored for subsequent positioning operations as the zero reference position. After the ink-metering element has been positioned in the zero position (the representative value of which is stored), the ink-metering element is automatically reopened, and the next ink-metering element is put through the same process.

In one procedure, only one ink-metering element at a time is moved towards the duct roller, i.e., all the other ink-metering elements are deactivated or otherwise positioned so as to be not adjacent the roller. In this procedure, the noise detected at the tip of an ink-metering element results from the selected element only and not from nearby elements which might otherwise be touching the duct roller. However, since the detected noise level that results from the interference of neighboring ink-metering elements contacting the roller is relatively slight, in an alternative procedure some or all of the ink-metering elements can be simultaneously moved towards the duct roller in order to find the zero positions for the group of elements. This method further allows the dimensions (resulting sag) of the duct roller to be detected and quickly calculated by comparing the zero positions of the plurality of elements.

Other objects and advantages of the invention will become apparent upon consideration of the following detailed description when taken in conjunction with the drawings, in which:

While the invention is described in connection with certain preferred embodiments, there is no intent to limit the invention to those embodiments. On the contrary, the intent is to cover all alternatives, modifications and equivalents included within the spirit and scope of the invention as defined by the appended claims.

DETAILED DESCRIPTION OF THE PREFERRED EMBODIMENTS

Figure 1:
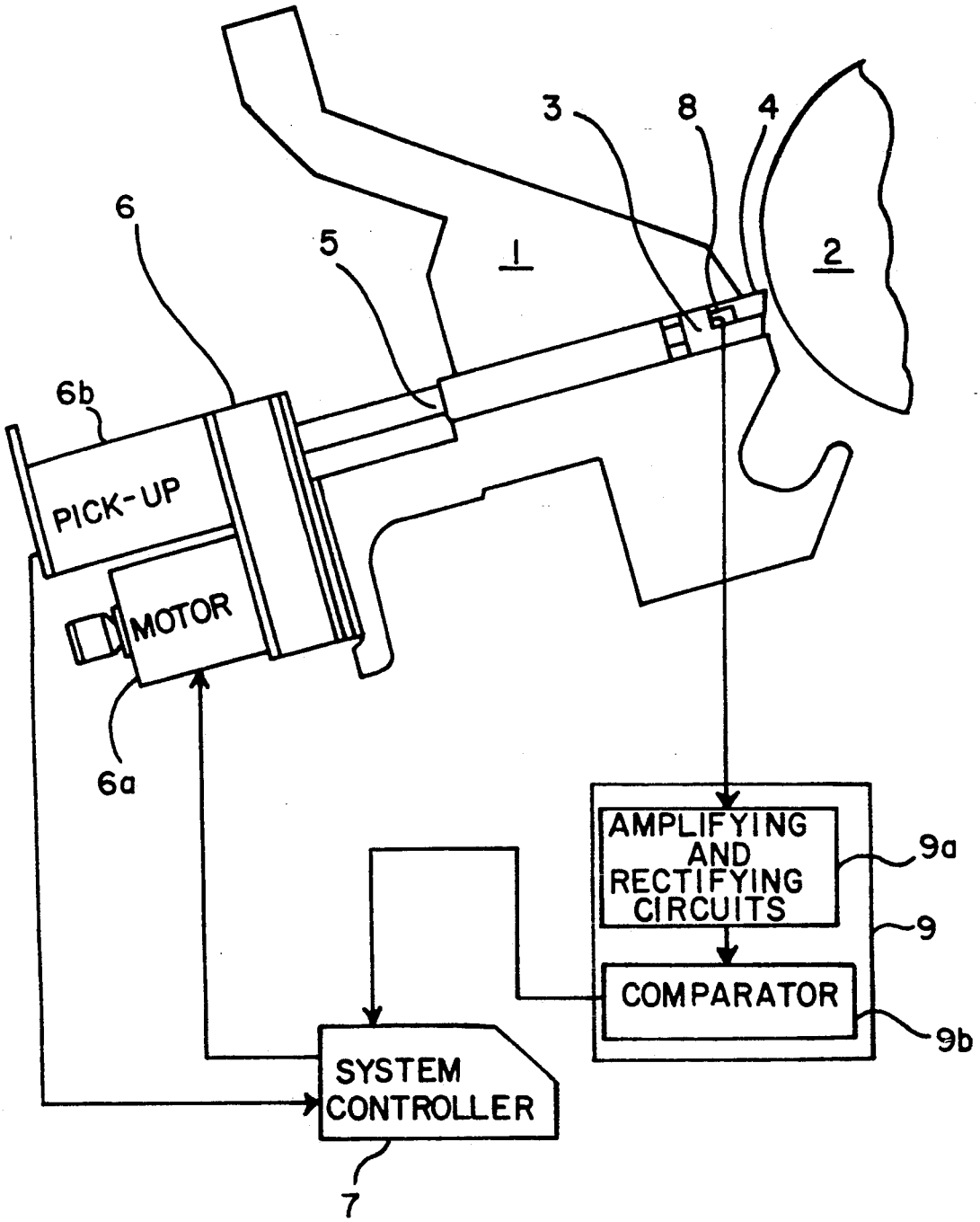
FIG. 1 shows a cross-section through a duct and an ink-metering element according to the invention.

Turning now to the drawings and referring first to FIG. 1, there is shown a duct 1 cooperating with a duct roller 2. At the lower end of the duct, an ink-metering element 3 is inserted into a guide (not shown) which allows the ink-metering element 3 to be moved toward or away from the duct roller 2. The movement of the ink-metering element relative to the duct roller 2 is accomplished by the rotation of an adjusting screw 5. In the preferred embodiment, the ink-metering element 3 includes a movable tip 4 which is mounted on the body of the ink-metering element 3 so that the tip is independently adapted to the contour of the duct roller 2 (see FIG. 2).

The screw 5 is adjusted by operating an adjusting drive 6. In one embodiment, the adjusting drive 6 comprises a motor 6a and a pick-up 6b. The pick-up 6b might comprise, for example, a potentiometer mechanically coupled to the motor 6a. The potentiometer is also coupled to a predetermined reference voltage so that the position of (i.e. the distance from, or the gap resulting from) the movable tip 4 of the ink-metering element 3 relative to the duct roller 2 is represented by a voltage. As the actuating motor 6a turns the screw 5 and moves the element 3 toward or away from the roller 2, the potentiometer 6b is also adjusted, resulting in a measurable voltage increasing or decreasing with the movement. When contact between the metering element 3 and the roller 2 is acoustically detected, the voltage provided at that instant across the potentiometer 6b is measured and stored as a unique value representative of the zero position for that element. It will be readily appreciated that the voltage need not vary in any particular direction, nor does the voltage necessarily have to change in linear proportion to the distance.

Alternatively, the drive 6 could be, for example, a stepping motor, capable of being operated in incremental steps. The distance could then be easily determined by counting the steps, in which case the pick-up 6b (potentiometer) would be unnecessary for determining distance. Instead, in such an alternative embodiment, all that is required is means for counting the number of incremental steps through which the motor is driven.

Regardless of the type of drive and the distance measuring technique used, the drive 6 for adjusting each ink-metering element 3 is remotely controlled by a system controller 7. Referring to the embodiment employing the potentiometer, the signal voltage from pick-up 6b (potentiometer) is evaluated and stored in the system controller 7 for each ink-metering element 3 when the element 3 (or its movable tip 4) touches the duct roller 2. This stored voltage is representative of the zero position, since only when contact occurs is this particular voltage present. In the alternate embodiment, the step count is stored (or zeroed) when contact occurs.

Figure 2:
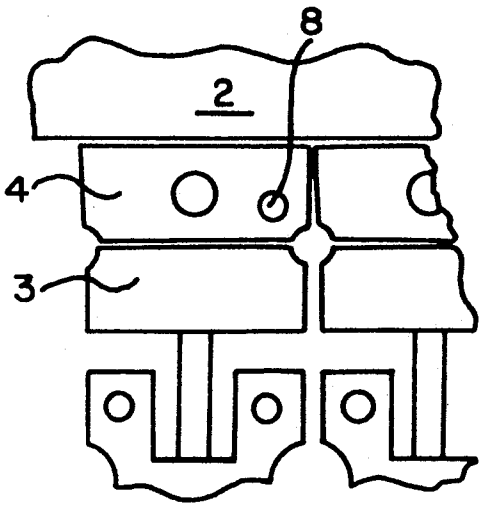
FIG. 2 shows a movable tip of the ink-metering element, including a noise sensor.

FIGS. 1 and 2 show a noise sensor 8 disposed in the movable tip 4 of the ink-metering element 3. The sensor 8 is preferably a piezo-ceramic noise sensor of well-known design and operation, and is in the form of a pellet having a diameter of 2 to 3 mm and a thickness of 1 to 2 mm. The end surfaces of the pellet are metallic and include electrodes for supplying a voltage which corresponds to a level of detected noise. The noise sensor 8 in each ink-metering element 3 is electrically coupled to an evaluating unit 9. The signals from the sensors are delivered to the evaluating unit 9 either by direct wiring, or after being combined onto a fewer number of wires using well-known multiplexing techniques (described hereinafter with FIG. 4).

In the preferred embodiment of the invention, the evaluating unit 9 comprises circuit elements 9a operating in a known manner for amplifying and rectifying the voltages delivered by the sensors 8. In this embodiment, the evaluating unit 9 also includes an adjustable-threshold voltage comparator 9b. The switching threshold of the comparator is set so that the comparator output toggles only when the noise level detected in the movable tip 4 becomes substantially higher than an incidental background noise level. This relative increase in the noise level results from the ink-metering element 3 sliding or rubbing against the rotating duct roller 2, i.e., at the zero position. Because the comparator threshold is set so as to allow toggling only at a substantial volume increase, false readings are generally avoided. Optionally, the evaluating unit 9 may also contain filters (not shown) for selectively amplifying only those frequency ranges in which there is a particularly significant change of noise level, thus further ensuring against false readings.

Figure 3:
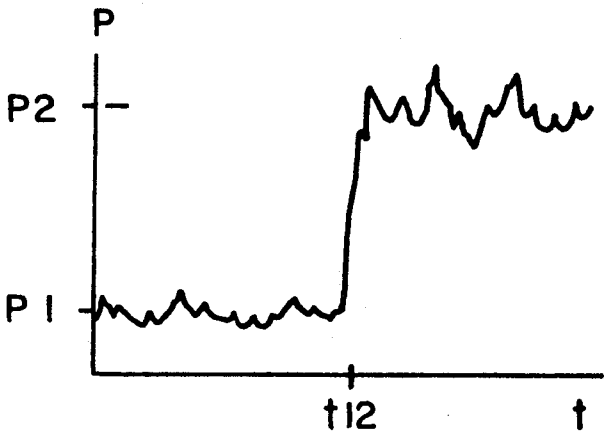
FIG. 3 is a graphical representation showing the noise level detected at the tip of the ink-metering element as a function of time, with the variation in the level caused by the ink-metering element contacting the roller.

FIG. 3 illustrates the variation in the detected noise level (P) with time (t). During the zeroing procedure, the adjusting drive 6 is switched on so as to move the ink-metering element 3 towards the rotating duct roller 2. During this movement, the noise sensor 8 detects a first level of noise (P1). As can be seen, this level is relatively low, being due primarily to background noise and other interference. At some time (t12), the movable tip 4 of the ink-metering element 3 reaches the surface of the duct roller 2 and rubs against it. As a result of this contact, the noise level (P) increases from (P1) to (P2), signalling that the ink-metering element 3 has reached the duct roller 2 (i.e., is touching it). The comparator 9b output generated by the evaluating unit 9 toggles, causing the representative signal (voltage) produced by the pick-up 6b (potentiometer) at that moment to be stored in the system controller 7. This representative voltage thus indicates the zero position, since only at this exact position will that exact voltage be produced. Simultaneously with the detection of the noise increase, the system controller 7 sends a signal halting the adjusting drive 6 so that the ink-metering element 3 is not pressed with excessive force against the duct roller 2.

Figure 4:
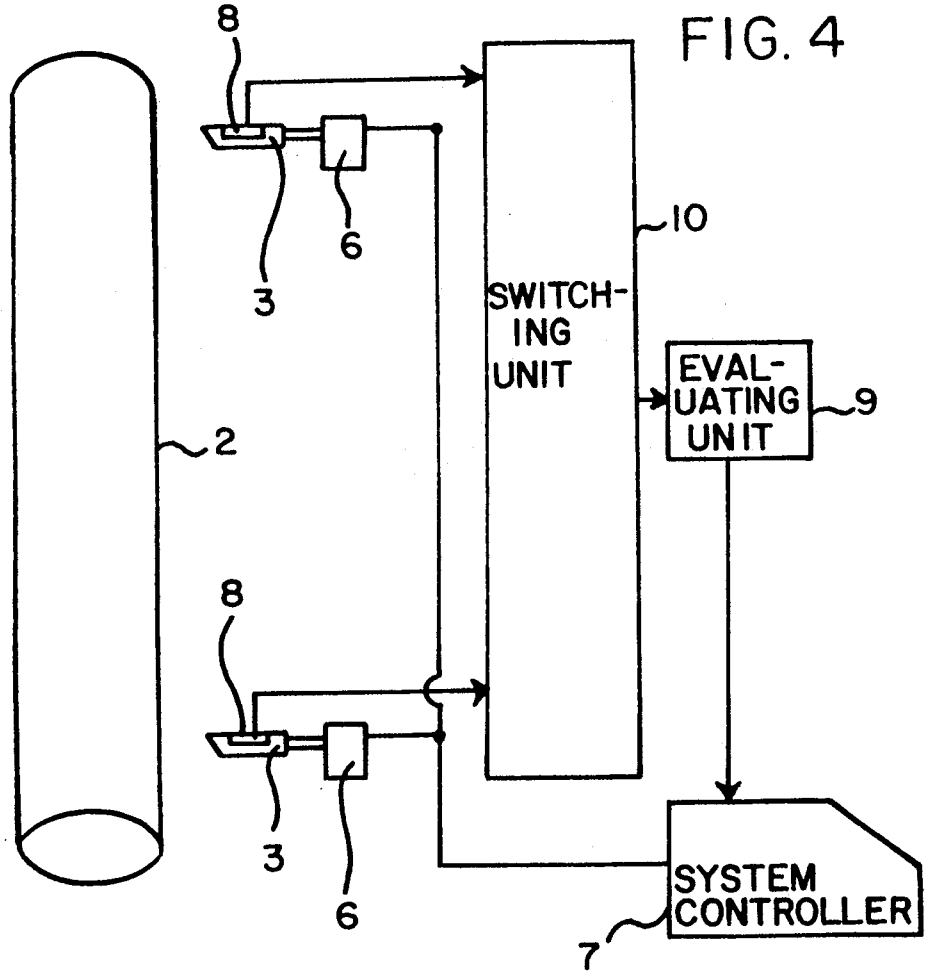
FIG. 4 shows the basic structure of an ink-metering system according to the invention.

FIG. 4 shows an ink-metering device of a duct roller 2 comprising a plurality of ink-metering elements 3, each having a noise sensor 8 and being connected to an evaluating unit 9 via a switching unit 10. The switching unit 10 can be a multiplexer, such as a time multiplexer, so that signals from each of the noise sensors 8 on the ink-metering elements 3 are connected to the evaluating unit 9 for a given time. In a simple embodiment of the invention, the switching unit, (multiplexer) 10 connects the evaluating unit 9 with the signal from the noise sensor 8 present in a single ink-metering element that is being adjusted. In such a system, the ink-metering elements 3 are preferably selected and adjusted in accordance with a program stored in the remote-control system 7.

As previously discussed, the invention is not limited to ink-metering elements 3 that have movable tips 4. However, a system having ink-metering elements with moveable tips 4 has certain advantages, such as the movable tip 4 taking up relatively little space. Moreover, in spite of accurate guidance, a tip is capable of making microscopic tilting movements around its axis of rotation when touching the rotating duct roller 2. Such "stick-slip" movements of a movable tip 4 result in detection of higher noise levels than in the case of a relatively larger tip of an ordinary ink-metering element. The rotatable guide also reduces the transmission of undesirable noise (e.g., the noise of the drive 6) from the ink-metering element 3 to the movable tip 4.

As can be seen from the foregoing detailed description, a simple, inexpensive and reliable method and system is provided for facilitating the establishment of a reference position for ink-metering elements relative to a duct roller. This method and system requires only a slight and inexpensive modification of existing ink-metering elements, and functions regardless of the conductive characteristics of the ink.

What is claimed is:

1. A method for establishing a reference position for an ink-metering element relative to a duct roller of a printing machine, the method comprising the steps of:
creating a bore in the ink-metering element;
inserting an acoustic sensor into the bore for acoustically coupling the ink-metering element to the sensor;
rotating the duct roller;
moving the ink-metering element toward the rotating duct roller;
monitoring the physical position of the ink-metering element;
acoustically sensing a sound level at the acoustic sensor in the bore within the ink-metering element; and
upon sensing a predetermined change in the sound level which is indicative of the ink-metering element contacting the rotating duct roller, recording the physical position of the ink-metering element as the reference position.

2. The method of claim 1, wherein the step of moving the ink-metering element comprises operating a motor and thereby driving a moveable linkage which is physically coupled to the ink-metering element.

3. The method of claim 2, wherein the step of monitoring the physical position of the ink-metering element comprises coupling a potentiometer to the moveable linkage and thereby, as the linkage is driven by the motor, generating a voltage signal having a value representative of the physical position of the ink-metering element.

4. The method of claim 1, wherein the step of monitoring the physical position of the ink-metering element comprises generating a signal having a value representative of the physical position of the ink-metering element.

5. The method of claim 1, wherein the acoustic sensing step comprises associating an acoustic sensor with the ink-metering element and thereby generating an electrical signal having a value representative of a sound level in the environment surrounding the ink-metering element.

6. The method of claim 5, further comprising the steps of feeding the electrical signal from the acoustic sensor to a comparator network and toggling an output of the comparator network when the value of said electrical signal rises to a predetermined value which is representative of a sound level that occurs when the ink-metering element contacts the rotating duct roller, wherein the toggling of the output causes the physical position of the ink-metering element to be recorded.

7. The method of claim 1, wherein a single ink-metering element is moved toward the duct roller while no other ink-metering elements are in contact with the roller.

8. A system for establishing a reference position for an ink-metering element relative to a rotating duct roller of a printing machine, the system comprising:
means for providing a signal corresponding to the distance between the ink-metering element and the duct roller;
an acoustic sensor associated with the ink-metering element which senses a sound level in the environment surrounding the ink-metering element and provides an electrical output signal corresponding thereto;
evaluating means responsive to the electrical signal output by the acoustic sensor for providing a first signal indicative of a sensed sound level below a threshold level and a second signal indicative of a sensed sound level above the threshold level;
a motor for moving the ink-metering element relative to the duct roller; and
control means for operating the motor to move the ink-metering elements relative to the duct roller, and for receiving and controlling storage of the signal corresponding to the distance between the ink-metering element and the duct roller, wherein the control means stores the distance signal as a reference position for the ink-metering element when the evaluating means changes from outputting the first signal indicative of a sound level below a threshold level to outputting the second signal indicative of a sound level above a threshold level, the sound level changing when the ink-metering element contacts the duct roller.

9. The system of claim 8, wherein the acoustic sensor is a piezo-ceramic sound transducer.

10. The system of claim 8, wherein the ink-metering element includes a bore, and the acoustic sensor is inserted into the bore and acoustically coupled to the ink-metering element.

11. The system of claim 8, wherein the signal corresponding to the distance between the ink-metering element and the duct roller is a voltage varying with the distance therebetween.

12. The system of claim 11, wherein a moveable linkage is coupled between the motor and the ink-metering element, and a potentiometer is coupled to the moveable linkage and generates the varying voltage.

13. The system of claim 8, wherein the signal corresponding to the distance between the ink-metering element and the duct roller is an incremental count, the value of the count varying with the distance therebetween.

14. The system of claim 8, wherein the evaluating means comprises a comparator network.

15. A system for establishing a reference position for an ink-metering element relative to a rotating duct roller of a printing machine, the system comprising:
means for providing a signal corresponding to the distance between the ink-metering element and the duct roller;
a bore disposed in the ink-metering element;
an acoustic sensor disposed within the bore and acoustically coupled to the ink-metering element which senses a sound level in the environment surrounding the ink-metering element and provides an electrical output signal corresponding thereto;
evaluating means responsive to the electrical signal output by the acoustic sensor for providing a first signal indicative of a sensed sound level below a threshold level and a second signal indicative of a sensed sound level above the threshold level;
a motor for moving the ink-metering element relative to the duct roller; and
control means for operating the motor to move the ink-metering elements relative to the duct roller, and for receiving and controlling storage of the signal corresponding to the distance between the ink-metering element and the duct roller, wherein the control means stores the distance signal as a reference position for the ink-metering element when the evaluating means changes from outputting the first signal indicative of a sound level below a threshold level to outputting the second signal indicative of a sound level above a threshold level, the sound level changing when the ink-metering element contacts the duct roller.

* * * * *